US011306409B2

(12) United States Patent
Parker

(10) Patent No.: US 11,306,409 B2
(45) Date of Patent: Apr. 19, 2022

(54) METHOD TO ENABLE ELECTROPLATING OF GOLDEN SILVER NANOPARTICLES

(71) Applicant: AG-NANO SYSTEM LLC, Sterling Heights, MI (US)

(72) Inventor: Margaret Parker, Bloomfield Hills, MI (US)

(73) Assignee: AG-NANO SYSTEM LLC, Sterling Heights, MI (US)

( * ) Notice: Subject to any disclaimer, the term of this patent is extended or adjusted under 35 U.S.C. 154(b) by 0 days.

(21) Appl. No.: 16/849,666

(22) Filed: Apr. 15, 2020

(65) Prior Publication Data

US 2020/0370191 A1 Nov. 26, 2020

Related U.S. Application Data

(60) Provisional application No. 62/852,068, filed on May 23, 2019.

(51) Int. Cl.
*C25D 5/12* (2006.01)
*C25D 3/38* (2006.01)
(Continued)

(52) U.S. Cl.
CPC ..... *C25D 5/12* (2013.01); *C25D 3/12* (2013.01); *C25D 3/38* (2013.01); *C25D 5/18* (2013.01); *C25D 5/34* (2013.01); *C25D 21/12* (2013.01)

(58) Field of Classification Search
None
See application file for complete search history.

(56) References Cited

U.S. PATENT DOCUMENTS 3,698,880 A * 10/1972 Koons ..... C22C 5/00 428/630
9,680,246 B2 6/2017 Takahashi
(Continued)

FOREIGN PATENT DOCUMENTS

JP 2012067388 4/2012

OTHER PUBLICATIONS

Sandmann et al., "Preparation of silver nanoparticles on ITO surfaces by a double-pulse method" J. Electroanalytical Chemistry, 491, 2000, 78-86. (Year: 2000).*
(Continued)

*Primary Examiner* — Stefanie S Wittenberg

(57) ABSTRACT

A method to enable electroplating of nano-silver like gold material ($[Ag_{25}(SR)_{18}]^-$ where SR is a thiolate). The method includes activating a surface of a substrate using first counter flow conditioning rinses (CFCR) with a solution of acetone followed by a solution of alcohol; rinsing the substrate surface; drying using a nitrogen gas; cleaning using a soak-clean solution; activating using an activator solution; rinsing using an ammonia dead rinse solution; conditioning using second CFCR; etching using hydrochloric acid; rinsing third CFCR; depositing woods nickel strike material and electrolytic nickel metal; electrodeposition of a gold strike metal to the surface of the substrate; and electroplating of a nano-silver like gold material and a nano-silver like gold alloy material on to the surface of the substrate using an electroplating solution and a rate of deposition 0.0001 μm/h.

10 Claims, 12 Drawing Sheets

(51) Int. Cl.

| | |
|---|---|
| ***C25D 3/12*** | (2006.01) |
| ***C25D 5/34*** | (2006.01) |
| ***C25D 21/12*** | (2006.01) |
| ***C25D 5/18*** | (2006.01) |

(56) References Cited

U.S. PATENT DOCUMENTS

| | | | | |
|---|---|---|---|---|
| 2018/0265997 | A1* | 9/2018 | Mora | C25D 15/02 |
| 2018/0325429 | A1* | 11/2018 | Umasankar | G01N 27/4074 |
| 2019/0271093 | A1 | 9/2019 | Neoh et al. | |

OTHER PUBLICATIONS

Jin et al., "All-thiolate-protected silver and silver-rich alloy nanoclusters with atomic precision: stable sizes, structural characterization and optical properties", CrystEngComm, 2016, 18, 3996. (Year: 2016).*

Lin et al., "The synthesis of Chiral Ag4Pd2(SR)8 by Nonreplaced Galvanic Reaction", Particle & Particle Systems Characterization, 2019, 1900003. (Year: 2019).*

* cited by examiner

| Size (nm) | Mass Concentration (mg/mL) | Atomic (Ag) Molarity (mmol/L) | Particle Concentration (particles/mL) | Ag-Nano Mass Percent (%) | Max Optical Density ($cm^{-1}$) | Peak Wavelength (nm) |
|---|---|---|---|---|---|---|
| 5 | 0.02 | 0.185 | $2.8 \times 10^{13}$ | 0.002 | 2.1 | 400 |
| 10 | 0.02 | 0.185 | $3.6 \times 10^{12}$ | 0.002 | 3.1 | 390 |
| 20 | 0.02 | 0.185 | $4.5 \times 10^{11}$ | 0.002 | 3.2 | 390 |
| 30 | 0.02 | 0.185 | $1.3 \times 10^{11}$ | 0.002 | 3.1 | 400 |
| 40 | 0.02 | 0.185 | $5.7 \times 10^{10}$ | 0.002 | 2.7 | 410 |
| 50 | 0.02 | 0.185 | $2.9 \times 10^{10}$ | 0.002 | 2.3 | 420 |
| 60 | 0.02 | 0.185 | $1.7 \times 10^{10}$ | 0.002 | 1.9 | 430 |
| 70 | 0.02 | 0.185 | $1.1 \times 10^{10}$ | 0.002 | 1.6 | 450 |
| 80 | 0.02 | 0.185 | $7.1 \times 10^{9}$ | 0.002 | 1.2 | 560 |
| 100 | 0.02 | 0.185 | $3.6 \times 10^{9}$ | 0.002 | 0.9 | 585 |
| 200 | 0.02 | 0.185 | $4.5 \times 10^{8}$ | 0.002 | 0.4 | 590 |

FIG. 8

| Element | Weight % | |
|---|---|---|
| | **CORE** | **COAT** |
| Cu | > 99% | 53.51% |
| Zn | < 0.5% | < 0.02% |
| Ag | < 0.01% | 6.76% |
| Au | < 0.01% | 1.10% |
| NI | < 0.01% | 38.61% |

FIG. 10

| SAMPLE | X ray fluorescence thickness measurement | |
|---|---|---|
| | micro inches | microns |
| 01 | 127 | 3.18 |
| 02 | 159 | 3.97 |
| 03 | 162 | 4.05 |

FIG. 11

METHOD TO ENABLE ELECTROPLATING OF GOLDEN SILVER NANOPARTICLES

FIELD OF THE INVENTION

The present disclosure relates generally to electroplating. More specifically, the present disclosure describes methods to enable electroplating of golden silver nanoparticles.

BACKGROUND OF THE INVENTION

"Golden" silver nanoparticles have an atomically precise molecular formula $[Ag_{25}(SR_{18}]^-$ (—SR is a thiolate) and is the only silver nanoparticle that has a virtually identical analogue in gold, i.e., $[Au_{25}(SR)^{18}]^-$, in terms of number of metal atoms, ligand count, superatom electronic configuration, and atomic arrangement. Furthermore, both $[Ag_{25}(SR)_{18}]^-$ and its gold analogue share a number of features in their optical absorption spectra. In other words, such silver nanoparticles look and behave like gold despite underlying differences between the two elements.

Gold electroplated electronic components, connectors and integrated circuitry are typically used in electronic equipment, hardware systems and industrial applications such as aerospace, automotive, computers, medical equipment. Such electroplating are often required to adhere electroplating standards set by AMS 2422, ASTM B488, and MIL-G-45204.

BRIEF DESCRIPTION OF THE DRAWINGS

Some of the embodiments will be described in detail, with reference to the following figures, wherein like designations denote like members, wherein:

FIG. 8 is a table depicting the concentration of the nanoparticles of Test Samples 1-3 of FIGS. 3, 4, and 5 according to some embodiments.

FIG. 10 is a table depicting the weight percentages of the elements of Test Samples 1-3 according to other embodiments.

FIG. 11 is a table depicting X-ray fluorescence thickness measurements of Test Samples 1-3 according to yet still other embodiments.

Figure 1:
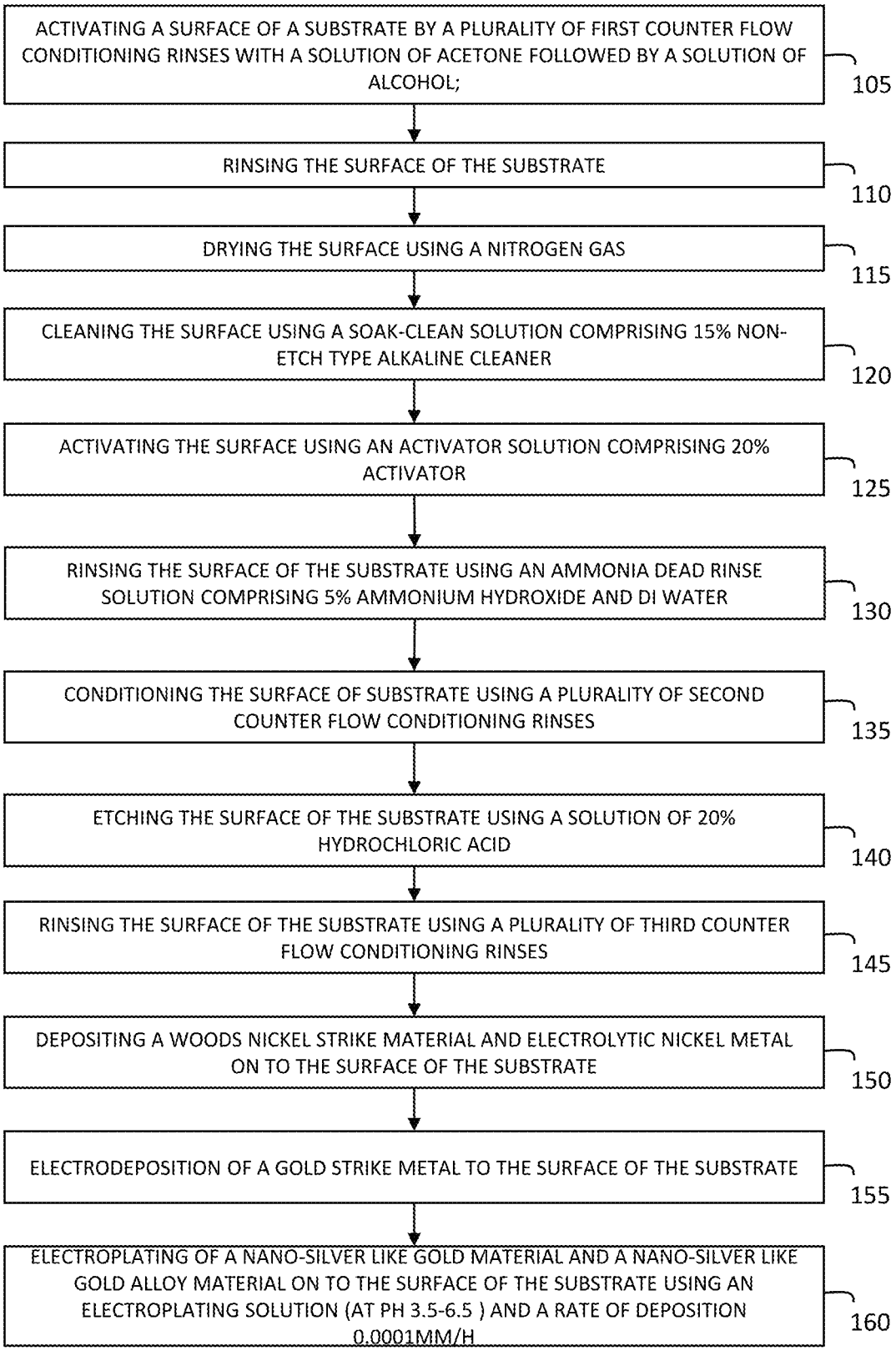
FIG. 1. illustrates steps for a method to enable electroplating of nanomaterial (e.g., on to beryllium copper substrates) according to some embodiments.

Unless otherwise specifically noted, articles depicted in the drawings are not necessarily drawn to scale.

DETAIL DESCRIPTIONS OF THE INVENTION

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

The present disclosure includes many aspects and features. Moreover, while many aspects and features relate to, and are described in the context of methods to enable electroplating of golden silver nanoparticles, embodiments of the present disclosure are not limited to use only in this context.

Golden silver nanoparticles have an atomically precise molecular formula $[Ag_{25}(SR)_{18}]^-$ (—SR: thiolate) and single-crystal structure determined. This synthesized nanocluster is the only silver nanoparticle that has a virtually identical analogue in gold, i.e., $[Au_{25}(SR)_{18}]^-$, in terms of number of metal atoms, ligand count, superatom electronic configuration, and atomic arrangement. Furthermore, both $[Ag_{25}(SR)_{18}]^-$ and its gold analogue share a number of features in their optical absorption spectra. In other words, such silver nanoparticles look and behave like gold despite underlying differences between the two elements.

Plated electronic components, such as connectors or integrated circuitry for electronic equipment or other hardware system and industrial applications such as aerospace, automotive, computers, medical equipment, are usually governed by a plurality of standards, which includes, but is not limited to AMS 2422, ASTM B488, MIL-G-45204. Together, the standards may be summarized as follows: a plating thickness of at least 50 ASTM Type III purity level (99.9% golden silver nanoparticles minimum), ASTM Type I (99.7% golden silver nanoparticles minimum).

To begin, the golden silver nanoparticles ("the nanoparticles") are silver nanoparticles that possess an atomically precise molecular formula $[Ag_{25}(SR)_{18}]^-$ (—SR: thiolate). The nanoparticles are preferably silver nanoparticles between 1-100 nm in size. The nanoparticles are the only silver nanoparticles that have an virtually identical analogue in gold, i.e., $[Au_{25}(SR)_{18}]^-$, in terms of number of metal atoms, ligand count, super-atom electronic configuration, and atomic arrangement. Furthermore, both the nanoparticles and its gold analogue share a number of features in their optical absorption spectra. The nanoparticles arguably offer the first model nanoparticle platform to explore the centuries-old problem of understanding the fundamental differences between silver and gold in terms of nobility, catalytic activity, and optical property.

The nanoparticles share of the same material properties as gold such as: superb low-voltage electrical conductivity, excellent thermal conductivity, high resistance to corrosion (e.g., in this specific atomic configuration the nanoparticles do not tarnish), ductility, excellent solderability, yellow lustrous metal in appearance. Specifically, the nanoparticles have a thermal conductivity of 429 W/mK, an electrical resistivity of 22Ω·m, a density of 9.320 g/cm$^3$, and a melting point of 961.78° C. (1763.204° F.).

The instant disclosure seeks to provide methods to enable electroplating of the nanoparticles, which mimic gold appearance and a plurality of its properties. The size, shape, and surface morphology play an important role in controlling the chemical, physical, optical, and electronic properties of the nanoparticles. The methods disclosed herein use $Ag_{25}(SR)_{18}^-$ (R═H, $PhMe_2$) nanoclusters, which are thiolate-protected silver clusters that have a matching analogue in gold. Methods disclosed herein use a silver nanomaterial (i.e. the nanoparticles) having the properties and appearance of gold. The methods disclosed herein also seek to provide a viable alternative to gold plating processes that are utilized in, for example, the electronics industry as well as the fabrication of connectors and integrated circuitry for electronic equipment and/or other hardware systems.

The novel electroplating system disclosed herein also has cost saving benefits. For example, gold and silver spot price potentially hinder the long term use of such materials for electroplating purposes. Comparatively, the nanoparticles are cost effective and have a lower production cost than current gold coatings and is similar in appearance and performance.

The methods disclosed herein are preferably utilized to electroplate the nanoparticles onto a variety substrates that include, but are not limited to, GPO connectors and brass pins. The method, in general, includes an anode, a cathode, an electrolytic solution, a pulse plating current, and a pulse plating method. A plurality of electroplating baths may be utilized but should be avoided due to dispositive optoelectronic properties of the final products. As such, a non-cyanide acidic silver electroplating bath is utilized, according to preferred embodiments. The non-cyanide acidic silver electroplating bath contains a soluble silver salt, a thiosulfate complex, trisodium citrate as a reducing agent. The nanoparticles have a molecular of formula $[Ag_{25}(SR)_{18}]^-$ where $(SR)_{18}$ is a thiolate and R is a (H, $PhMe_2$) cluster. To be sure, the nanoparticles are the only thiolate-protected silver nanocluster that has a matching analogue in gold.

For example, the geometric and electronic modifications of $Ag_{25}(SH)_{18}^-$ upon photoexcitation are similar but less pronounced compared to $Au_{25}(SH)_{18}^-$. The electroplating bath also contains sodium hydroxide, sodium nitride, sodium sulfate, nano saccharin, and benzoic acid as a brightener. The non-cyanide acidic silver electroplating bath also contains a silver source, silver nitride ($AgNO_3$), at a concentration about 20-60 g/L and preferably 20-45 g/L.

Applicable thiosulphates include, but are not limited to, alkali metal thiosulphates or ammonium thiosulphate. The preferred thiosulphate is sodium thiosulphate. Not to be limited by theory, the thiosulphate forms a complex with the silver that employs about two moles of thiosulphate for each mole of silver. The trisodium citrate is employed as a reducing agent at a concentration of 10-60 g/L grams and preferable 30-50 g/L. Sodium hydroxide is subsequently added thereby causing a change in the master mix solution color to light yellow. The master mix solution is heated under continuous stirring using a magnetic stirrer at up to about 140° F. As used herein, the term "about" refers to +/−5° F. Subsequently, the sodium nitride and sodium sulfate are added to increase electroplating conductivity of the electroplating bath. Nano saccharin is added to act as a "grander" to facilitate formation of the nanoparticles with diameters of 30-40 nm and lengths of up to 50 μm.

In general, the electroplating bath may be maintained at pH of 3.5-6.5. According to preferred embodiments, the electroplating bath has a pH of 4.5-5.5. The addition of the silver nanoparticles act as a "leaven" to thereby form the nanoparticles. The average size of the nanoparticles, confirmed by TEM and SEM imaging, ranges from 15-500 nm. Particle size is preferably controlled by changing the reaction temperature, pH and the electroplating current condition. According to preferred embodiments, the pulse current has a current density of 45-200 ASF, a pulse frequency of 0-1200 Hz; an on-time of 0.3-3.0 ms, an off-time of 0.5-3.0 ms, and a duty cycle of 10-50%.

The nanoparticles are applied to substrate surfaces by electroplating in a manner that minimizes the formation of columnar and elongated grains and any undesirable crystallographic texture. According to preferred embodiments, electroplating the nanoparticles onto the surface of substrates (for example GPO connectors and brass pins) includes surface activation of the substrate to promote the adhesion of the metal electrolytic deposition of a thin layer of copper metal and nickel metal for brass pins and a thin layer of nickel metal for beryllium copper GPO connectors, electrolytic deposition of a thin layer of gold strike, and electroplating of the nanoparticle and/or an alloy of the nanoparticles to the substrate surface.

The nanoparticles may be electroplated on to beryllium copper substrates. For example, GPO connectors are typically made of beryllium copper. As used herein, the term "specimen" refers to beryllium copper substrates. The surface activation of the specimen preferably includes cleaning/activating of the surface of the substrate to promote metal adhesion via a plurality of first counter flow conditioning rinses. According to preferred embodiments, the first counter flow conditioning rinses include an acetone rinse followed by an alcohol (e.g., 50% methyl alcohol) rinse. Subsequently, nitrogen gas is used to dry the surface of the substrate. The dried surface is cleaned with 15% non-etch type alkaline cleaner (e.g., Isoprep 44®, Vender: MacDermid, Inc.) and activated using an activator solution that includes 20% activator (e.g., Multiprep 506®, Vender: Macdermid, Inc.).

Subsequently, the surface of the substrate is rinsed using an ammonia dead rinse solution of 5% ammonium hydroxide and DI water. The surface of substrate is conditioned by a plurality of second counter flow conditioning rinses of 5% ammonium hydroxide and DI water. The surface of the substrate is etched using a solution of 20% hydrochloric acid. A plurality of third counter flow conditioning rinses are used to rinse the surface of the substrate. A woods nickel strike material (e.g., as provided by Technic, Inc.) and electrolytic nickel (e.g., Techni-Nickel HT-2®, Technic, Inc.) are deposited onto the surface of the substrate. Gold strike (e.g., Technic ACR 41®, Technic, Inc) metal is electrodeposited onto the surface of the substrate. Subsequently, the nanoparticles are electroplated onto the surface of the substrate. According to preferred embodiments, the electroplating step requires a pH of 3.5-6.5 and a deposition rate of 0.0001 μm/h.

FIG. 1. illustrates steps for a method to enable electroplating of nanomaterial (e.g., on beryllium copper substrates) according to some embodiments. At Step 105, a surface of a substrate (e.g., a beryllium copper substrate) is activated by a plurality of first counter flow conditioning rinses with a solution of acetone followed by a solution of alcohol. Surface activation of the substrate promotes adhesion of the metal. At Step 110, the surface of the substrate is rinsed. At Step 115, the surface of the substrate is dried using nitrogen gas. At Step 120, the surface of the substrate is cleaned using a soak-clean solution that includes 15% non-etch type alkaline cleaner. At Step 125, the surface of the substrate is activated using an activator solution that includes 20% activator. At Step 130, the surface of the substrate is rinsed using an ammonia dead rinse solution that includes 5% ammonium hydroxide and DI water. At Step 135, the surface of substrate is conditioned using a plurality of second counter flow conditioning rinses.

At Step 140, the surface of the substrate is etched using a solution of 20% hydrochloric acid. At Step 145, the surface of the substrate is rinsed using a plurality of third counter flow conditioning rinses. In other embodiments, surface activation of substrates disclosed in the instant application is accomplished as follows: water is removed from the substrate; the substrate is immersed in acetone; the substrate is immersed in alcohol; the substrate is rinsed; the substrate is deoxidized (e.g., using a laser); the substrate is rinsed; the substrate is deoxidized using sulfuric acid; and the substrate is rinsed.

Figure 2:
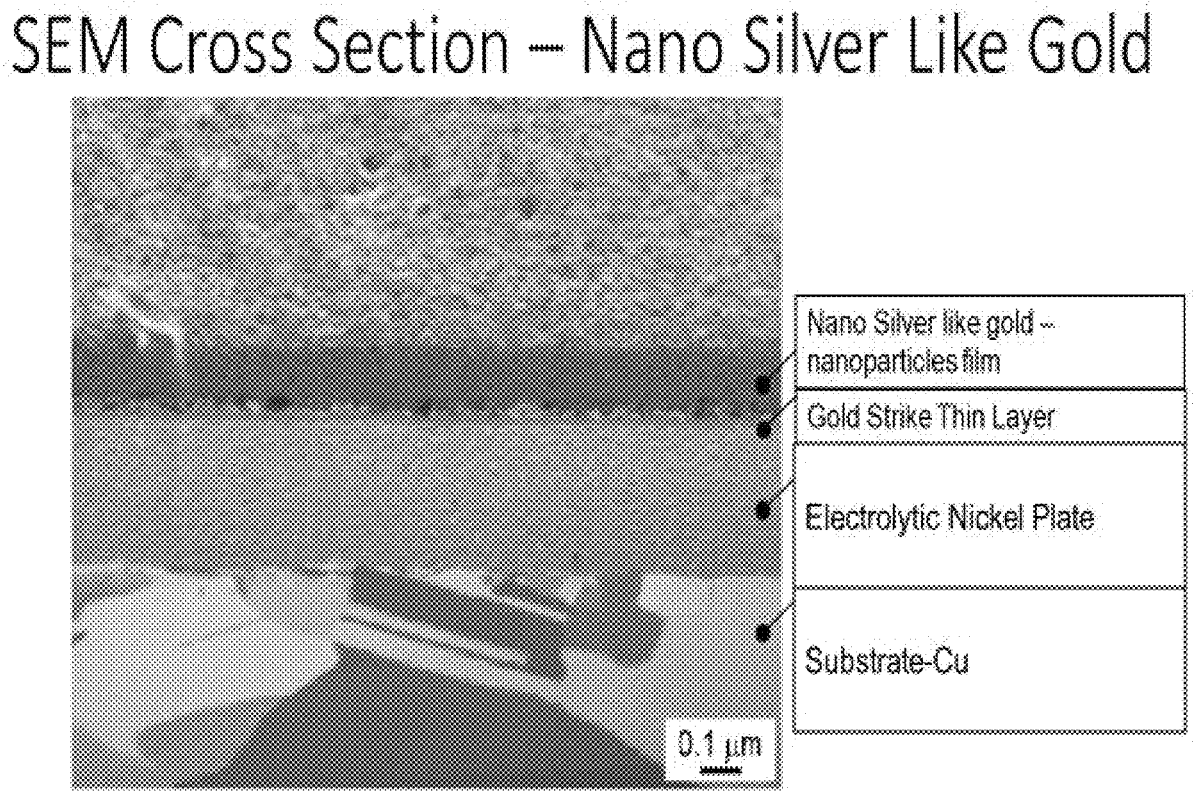
FIG. 2 is a cross-sectional scanning electron microscopy ("SEM") image captured at 3100× magnification of a copper substrate electroplated with the nanoparticles using the disclosed method according to some embodiments.
Figure 3:
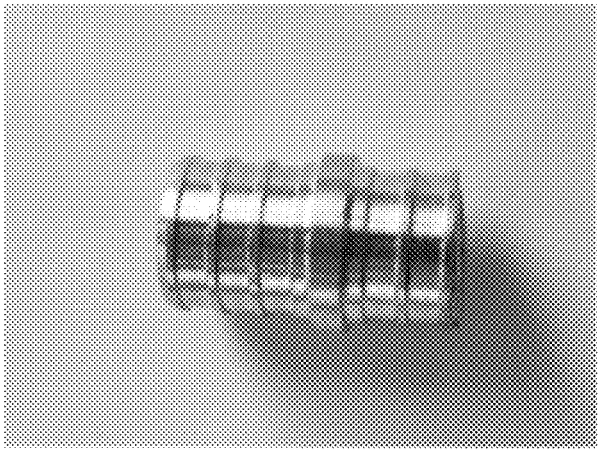
FIG. 3 depicts a copper push-on connector plated with an alloy according to certain embodiments.
Figure 4:
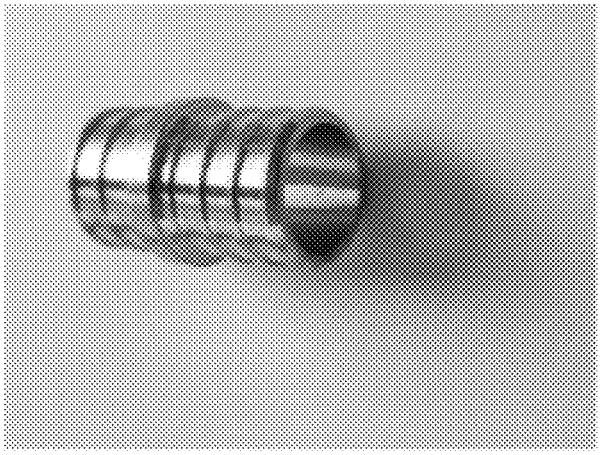
FIG. 4 depicts a copper push-on connector plated with an alloy according to certain embodiments.
Figure 5:
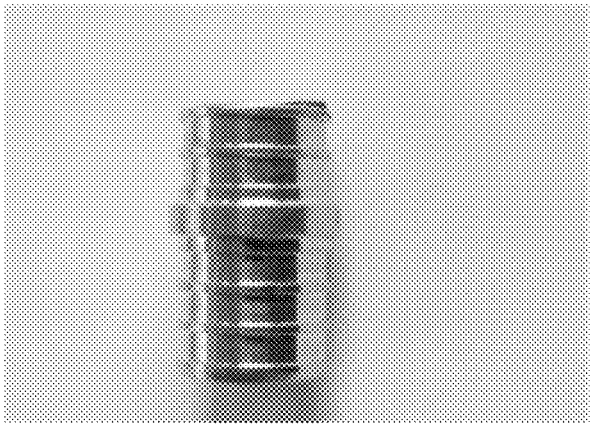
FIG. 5 depicts a copper push-on connector plated with an alloy according to certain embodiments.

At Step 150, a woods nickel strike material and electrolytic nickel metal are deposited on to the surface of the substrate. At Step 155, a gold strike metal is electroplated to the surface of the substrate. At Step 160, a nano-silver like gold material and a nano-silver like gold alloy material is electroplated on to the surface of the substrate using an electroplating solution and a rate of deposition 0.0001 μm/h. FIG. 2 is a cross-sectional scanning electron microscopy ("SEM") image captured at 3100× magnification of a copper substrate electroplated with the nanoparticles using the disclosed method according to some embodiments. The SEM image depicts a copper substrate plated with an electrolytic nickel. A thin layer of gold strike is plated on the electrolytic nickel and the nanoparticles are plated on the gold strike. FIGS. 3-5 depict examples of copper push-on connectors (Test Samples 1, 2, and 3) plated with an alloy of the nanoparticles according to some embodiments.

The nanoparticles may be electroplated onto the surfaces of brass substrates (e.g., brass pins). The electroplating of brass substrates, such as brass pins, preferably includes the steps of readying the surface of the substrate for the electroplating process, depositing metal onto the surface of the substrate, and electroplating the nanoparticles onto the surface of the substrate.

Readying the surface of the brass substrate for the electroplating process preferably includes cleaning/activating of the surface of the substrate to promote metallic adhesion using a plurality of first counter flow conditioning rinses that uses a solution acetone followed by a solution of alcohol. The cleaned/activated surface is dried using nitrogen gas and conditioned using a desmear solution that includes 15% conditioner (e.g., Ciricuposit 3320®, Dow Chemical, Inc.). The conditioned surface of the substrate is rinsed using a deoxidation solution that includes 30% deoxidatant (e.g., a peroxide-based chemical polishing solution such as Laser EX®). The substrate surface is further conditioned using a plurality of second counter flow rinses of 5% ammonium hydroxide and DI water, rinsed using a second deoxidation solution that includes 10% deoxidant, preferably sulfuric acid (e.g., Sulfuric Acid 66 Degrees BE'), and rinsed using a plurality of third counter flow conditioning rinses.

Depositing metal onto the surface of the substrate preferably includes depositing electrolytic copper, preferably acid copper, and electrolytic nickel (e.g., Techni-Nickel HT-2®, Technic Inc.) followed by the electrodeposition of gold strike (e.g., Technic ACR 41®, Vender: Technic Inc) metal to the surface of the substrate. The nanoparticles and/or alloys of the nanoparticles are preferably electroplated onto the surface of the substrate while the pH level of the electroplating solution is 3.5-6.5 and the rate of deposition is about 0.0001 μm/h.

Figure 6:
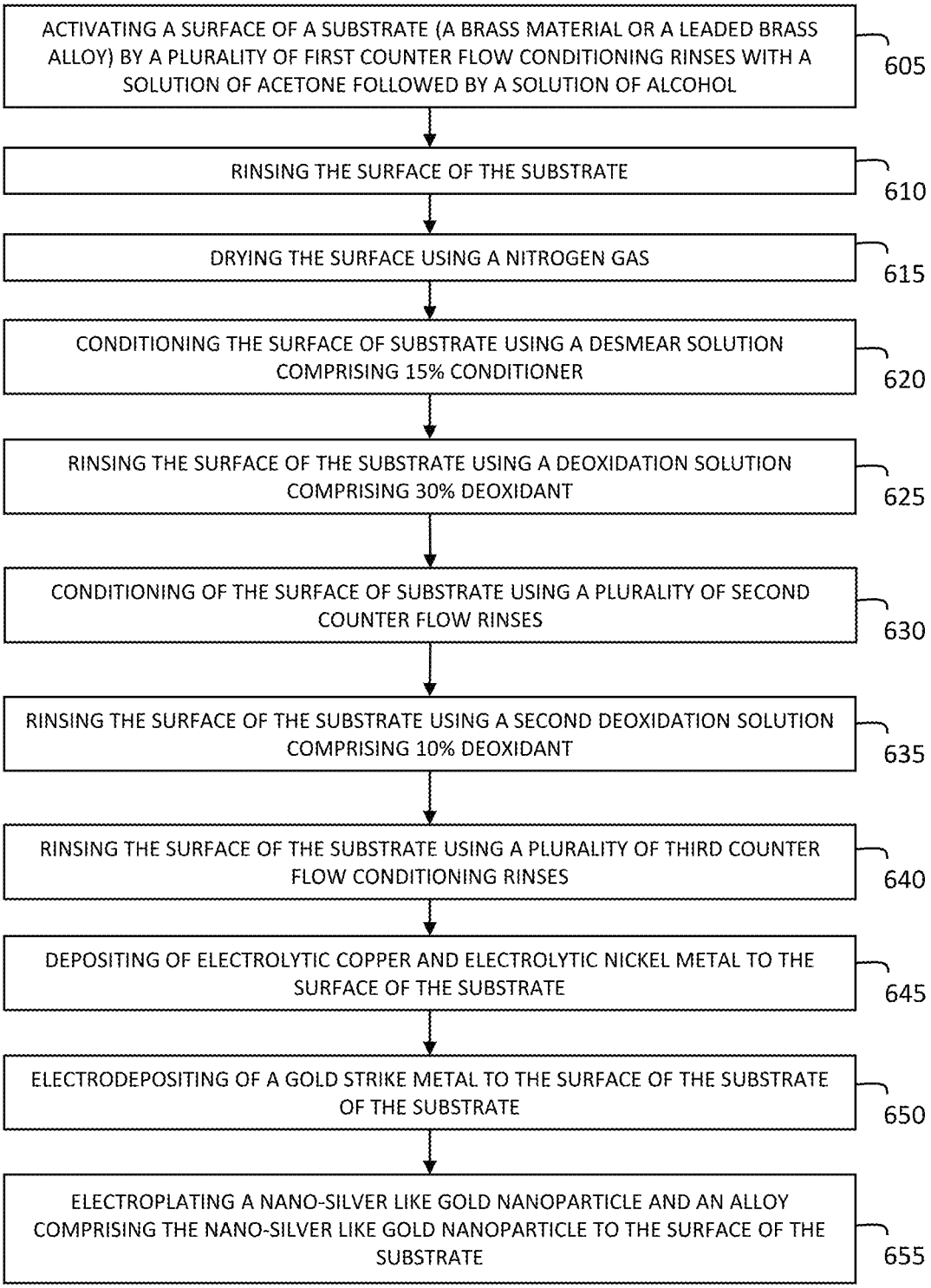
FIG. 6 depicts illustrates steps for a method to enable electroplating of nanomaterial (e.g., on to a brass and/or a leaded brass alloy) according to certain embodiments.

FIG. 6 depicts illustrates steps for a method to enable electroplating of nanomaterial according to certain embodiments. At Step 605, a surface of a substrate (e.g., a brass material or a leaded brass alloy) is activated by a plurality of first counter flow conditioning rinses with a solution of acetone followed by a solution of alcohol. At Step 610, the surface of the substrate is rinsed. At Step 615, the surface of the substrate is dried using nitrogen gas. At Step 620, the surface of substrate is conditioned using a desmear solution comprising 15% conditioner. At Step 625, the surface of the substrate is rinsed using a deoxidation solution comprising 30% deoxidant. At Step 630, conditioning of the surface of substrate is conditioned using a plurality of second counter flow rinses. At Step 635, the surface of the substrate is rinsed using a second deoxidation solution comprising 10% deoxidant.

Figure 7:
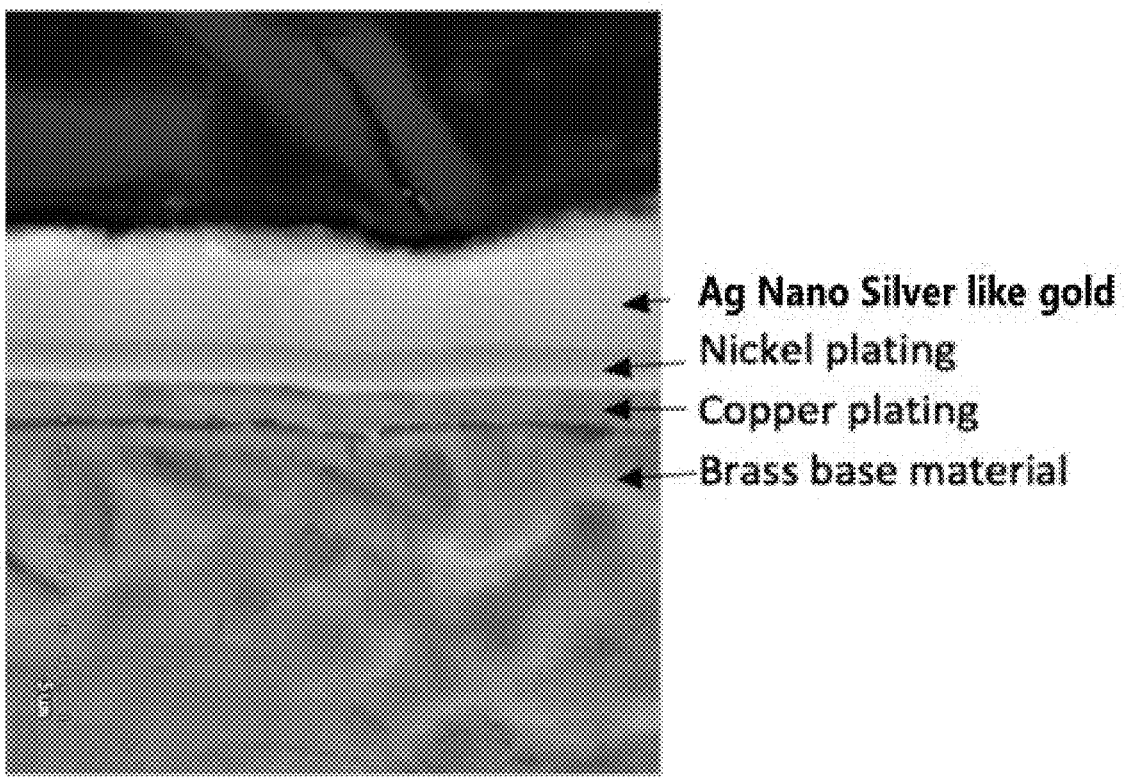
FIG. 7 is a cross-sectional SEM image of a brass substrate electroplated with the nanoparticles using the disclosed method according to other embodiments.

At Step 640, the surface of the substrate is rinsed using a plurality of third counter flow conditioning rinses. At Step 645, electrolytic copper and electrolytic nickel metal is deposited on to the surface of the substrate. At Step 650, a gold strike metal is electrodeposited on to the surface of the substrate of the substrate. At Step 655, nano-silver like gold nanoparticles (i.e. the nanoparticles) and an alloy that includes the nano-silver like gold nanoparticles (i.e. an alloy of the nanoparticles) are electroplated on to the surface of the substrate. FIG. 7 is a cross-sectional SEM image of a brass substrate electroplated with the nanoparticles using the disclosed method according to other embodiments. The SEM image was captured at 3100× and depicts a brass base material (i.e. substrate) plated with copper. A thin layer of nickel is plated on the copper plating and the nanoparticles are plated on the nickel plating.

The process of the electroplating of the nanoparticles uses an anode, a cathode, an external current, and an electrolyte solution. Here, the anode and cathode are immersed in the electrolyte solution and the external current is connected to the anode and cathode.

The applied voltage is preferably 1-6 V, wherein the external current comprises an anodic-current and a cathodic-current. The dissolution of the anode includes platinum and titanium alloy whereby the platinum in the anode acts as a catalyst to accelerate the oxidation process of the nanoparticles. Deposition of metallic of the nanoparticle alloys takes place in the cathode. When current flows the nano-silver like gold ions are reduced to metallic nano silver like gold nanoparticles on the cathode, for example, brass pins coated with thin layer of copper/nickel metal and of gold strike metal. Electroplating of nanoparticles is preferably uses pulse plating methods.

The preferred pulse plating method utilizes an electrolyte that includes an all salt solution dissolved in 1L of DI water. Specifically, the electrolyte solution includes silver nitride (20-120 g/L), trisodium citrate (10 g-110 g), sodium hydroxide (5-75 ml/L), the nanoparticles (0.5-10 g/L), sodium nitride (10-100 g/L), sodium sulfate (10-100 g/L), a sodium thiosulfate complex (200-500 g/L), mono saccharin (1-5 g/L), and benzoic acid (1-10 g/L), according to preferred embodiments. In other embodiments, the electrolyte can include different components, compositions, and/or concentrations than disclosed herein, but ultimately should be discouraged due to suboptimal photoluminescence (i.e. dullness) of the final products.

Conductivity between the anode (positive charge) and the cathode (negative charge) is provided by a non-cyanide acidic silver electroplating bath that contains a soluble silver salt, a thiosulfate complex, trisodium citrate as a reducing agent. As stated above, the nanoparticles have a molecular formula of $[Ag_{25}(SR)_{18}]^-$ where $(SR)_{18}$ is a thiolate, (R=H, $PhMe_2$) nanocluster and is currently the only thiolate-protected silver cluster that has a matching analogue in gold. Not to be limited by theory, the nanoparticles that appear and behave like gold due to a nanocluster of 25 silver atoms and with 18 other molecules, called "ligands", that surround the silver atoms. The entire negatively charged, silver-based complex ion has the chemical formula $[Ag_{25}(SPhMe_2)_{18}]^-$. Typically, silver nanoclusters are brown or red in color, but the nanoparticles have the appearance of gold because it reflects light at almost the same wavelength (~675 nm) as gold. The virtually identical crystal structures of both nanoclusters allows the nanoparticles to achieve their golden color.

During the electrochemical reaction, (electro-deposition) reduction occurs at the cathode where Ag+ nanoparticles are reduced to the nanoparticles and deposited at the cathode. Concomitantly, the oxidation reaction occurs at the anode to where the complex ion $[Ag_{25}(SPhMe_2)_{18}]^-$ migrates and oxidizes to $Ag_4O_2$, AgO, or $Ag_xO$ and two electrons are produced. The preferred pulse plating method is used to obtain crystals characterized by the amorphous structure (nano-structure) of the nanoparticles. The pulse plating current includes an on-time and an off-time.

During on-times, the nanoparticles are plated out of the electrolyte solution near the cathode interface. The cathode diffusion layer is formed until the current is terminated (i.e. off-time) during which the electrolyte solution near the cathode interface becomes replenished with the nanoparticles. The diffusion layer is maintained to achieve evenly distributed thickness of deposited nano silver like gold. Such procedure yields improvements in the density across the cathode surface and facilitates uniform deposit thickness. During the pulse electroplating process, re-nucleation typically occurs with each pulse, which thereby increases the number of grains and improves grain reinforcement and nano structure buildup. To achieve the aforementioned results, deposition rates are preferably configured to be at least 30 um/h, preferably at least 70 um/h, and more preferably greater than 90 um/h, by passing single or multiple D.C. cathodic-current pulses between the anode and the specimen.

The cathodic-current pulse frequency is preferably about 0-1200 Hz at pulsed intervals during which the external current on-time period is at least 0.1 ms and preferably about 0.1-100 ms and the off-time is about 0-500 ms. The anodic-current pulses has an anodic-time period of 0-100 ms. The cathodic duty cycle is 10-50%. Typically, the on-time may be 0.1-3.0 ms and the off-time 0.2-10.0 ms long.

The efficiency of pulse electroplating method disclosed herein was tested with the following parameters: an on-time of 0.3-3.0 ms; off-time of 0.5-3.0 ms; and a duty cycle of 10-50%. For an example, a 40% duty cycle means the power is on 40% of the time and off 60% of the time. The present invention generates the nanoparticles using current density of 45-200 ASF and a specific pulse management (e.g., $t_{ON}$=0.2 s, $t_{US}$=0.3 s, $t_p$=0.2 s). SEM and TEM images may be used to observe the morphological and dimensional features of the nanoparticles. The nanoparticles typically have a length 6-10,000 nm on average, but superior results are preferably achieved grain sizes less than 1000 nm.

Figure 9:
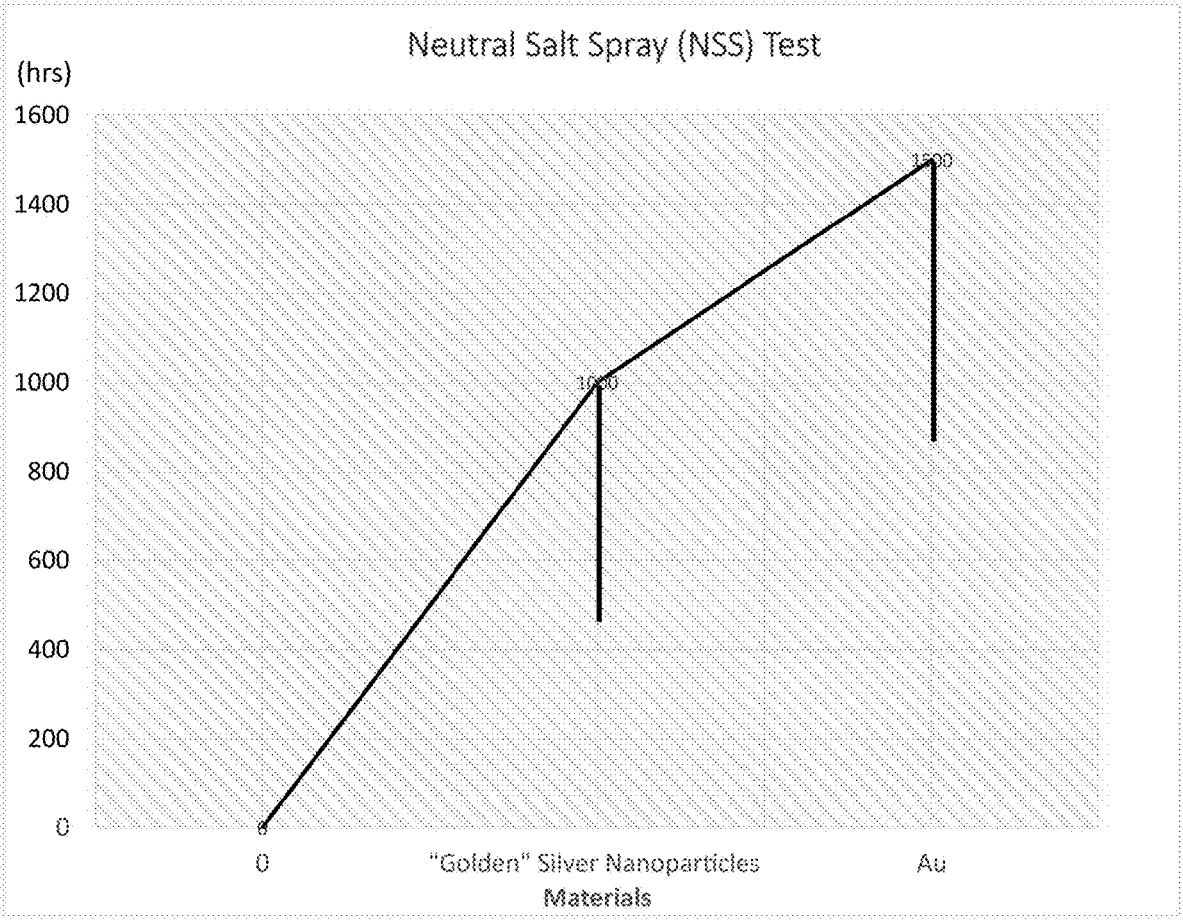
FIG. 9 is a graph of an ASTM B117 Neutral Salt Spray ("NSS") test of a copper substrate plated with 100 microinches of the nanoparticles versus a copper substrate plated with 100 microinches according to certain embodiments.
Figure 14:
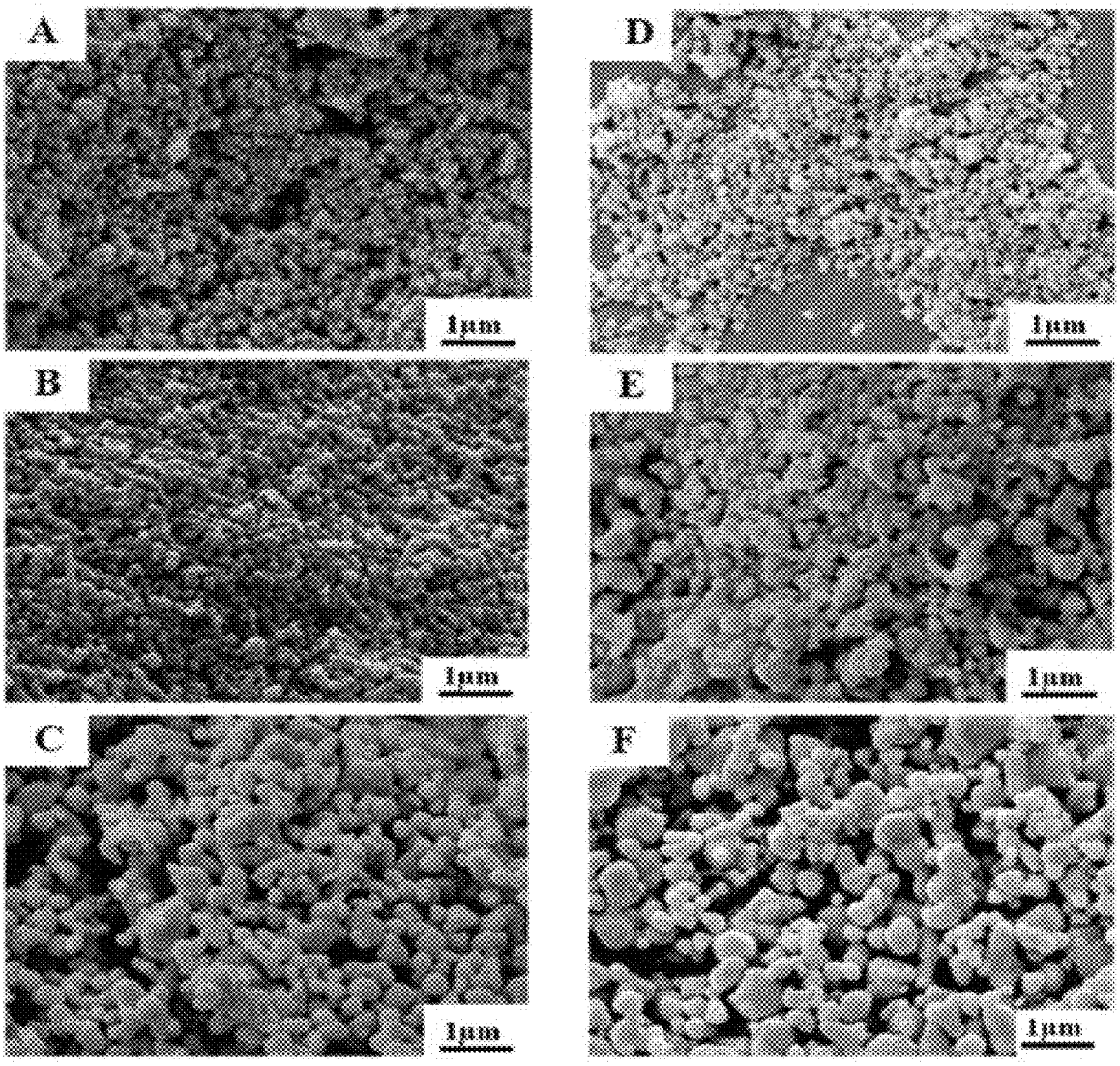
FIG. 14 illustrates high-resolution SEM images of the nanoparticles between 10-50 nm in diameter obtained using various current densities and pulse signals.

The thickness of the nanoparticles is time dependent. The novel electroplating methods disclosed herein can be optimized by modifying the solution temperature, pH level, and electroplating current conditions. For example, no deposits of the nanoparticle are observed at current densities lower than 10 ASF. When the current density is increased from 45-200 ASF, the $Ag_xO$ morphology (grain structure) appears to increase from hundreds of nanometers to several microns. FIG. 14 illustrates high-resolution SEM images of the nanoparticles between 10-50 nm in diameter obtained using various current densities and pulse signals. FIG. 8 is a table depicting the concentration of the nanoparticles of Test Samples 1-3 of FIGS. 3, 4, and 5 according to some embodiments. FIG. 9 is a graph of an ASTM B117 Neutral Salt Spray ("NSS") test of a copper substrate plated with 100 microinches of the nanoparticles versus a copper substrate plated with 100 microinches according to some embodiments. The nanoparticle-plated copper substrate achieved 1000 testing hours in NSS without appearance of corrosion products while the gold-plated copper substrate achieved 1500 testing hours.

FIG. 10 is a table depicting the weight percentages of the elements of Test Samples 1-3 according to other embodiments. FIG. 11 is a table depicting X-ray fluorescence thickness measurements of Test Samples 1-3 according to other embodiments.

Figure 12:
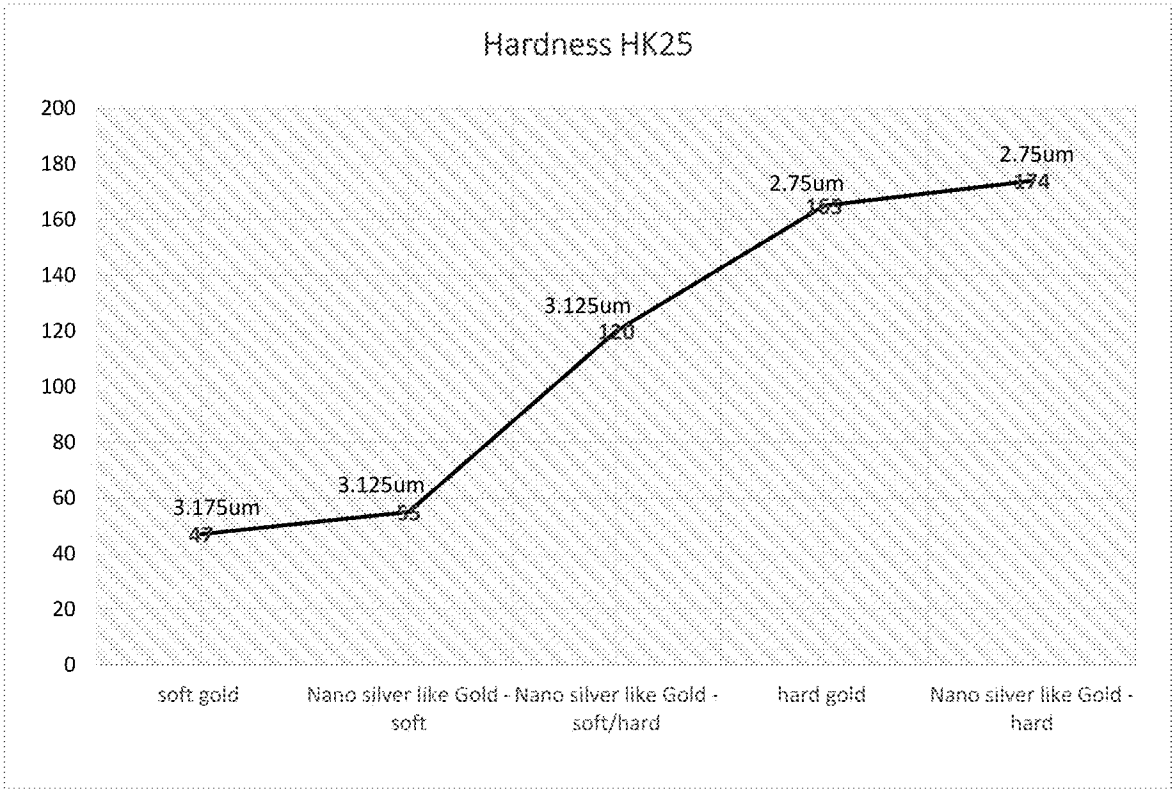
FIG. 12 is a graph depicting Knoop hardness measurements (HK25) according to some embodiments.
Figure 13:
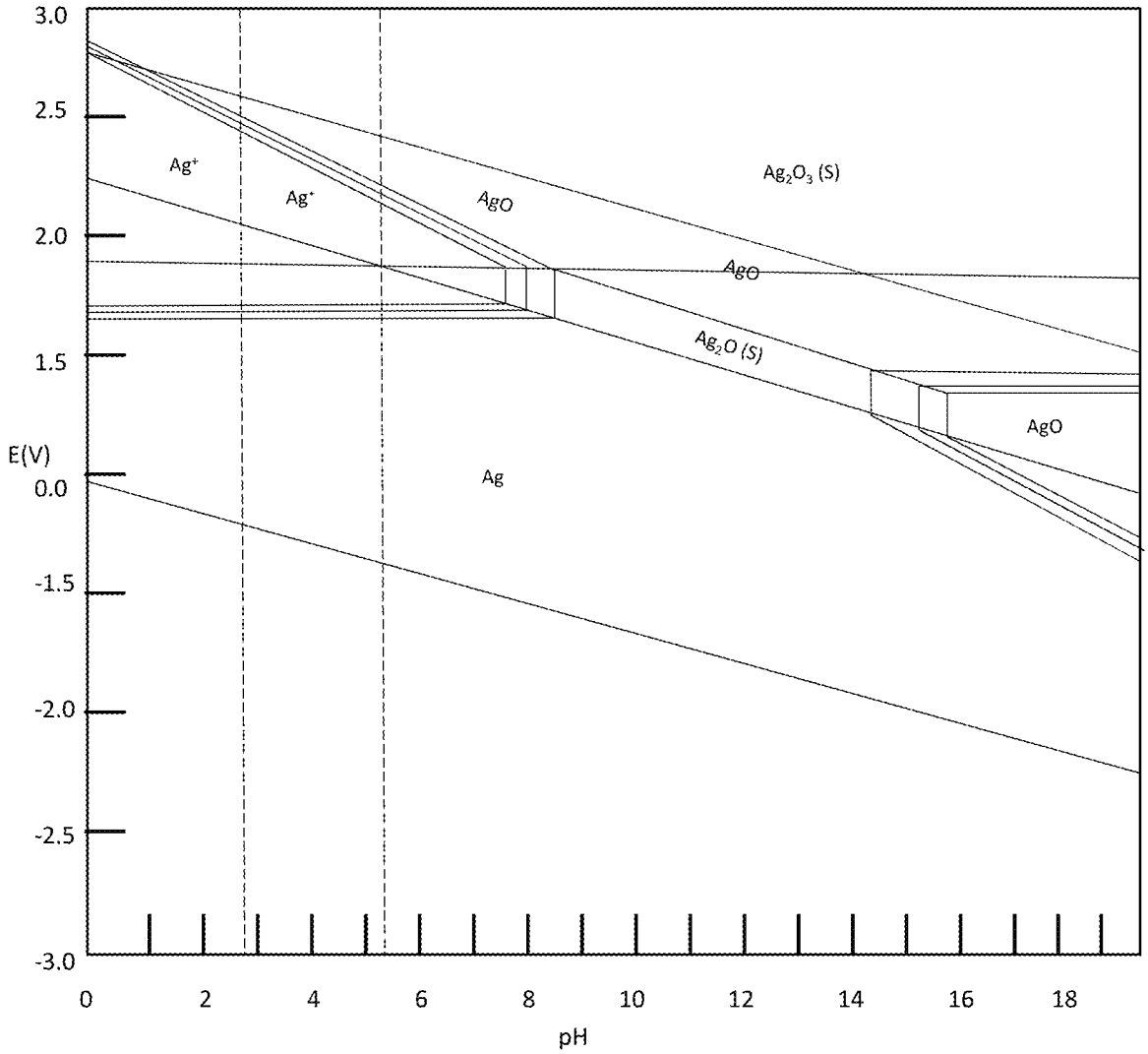
FIG. 13 depicts a Pourbaix diagram for the nanoparticles according to some embodiments.

FIG. 12 is a graph depicting Knoop hardness measurements (HK25) according to some embodiments. The Knoop graph compares copper substrates plated with soft gold, hard gold, a soft plating of the nanoparticles, and a hard plating of the nanoparticles. The data shows that the nanoparticle plating hardness is slightly higher than soft or hard gold hardness. The nanoparticle deposit consists of small grain size (nano-size) particles having a hardness 120-200 HK25, which is similar to the hard gold coating. The nanoparticle grain size depends on the pulse current plating parameters and electrolyte composition. The nanoparticle plating typically achieves a hardness of between 30-90 HK25. In certain embodiments, nickel sulfate hexahydrate (e.g., 0.96-3.5 g/L) is added to the electrolyte composition if a ASTM Type III coating of the nanoparticles is not obtained from the original electrolyte composition presented in this invention. FIG. 13, depicts a Pourbaix diagram for the nanoparticles according to some embodiments.

The novel electroplating methods disclosed herein demonstrate that silver can acquire the properties and appearance of gold and can replace gold in gold plating processes known in that art. A goal of the instant disclosure is to identify cost effective substitutes for gold in applications where gold nanoparticles are required. The novel electroplating methods disclosed herein are applicable in a variety of industries, such as aerospace, automotive, computer, consumer electronics, household appliances, medical equipment, oil & gas equipment, and electronic components (e.g., connectors or integrated circuitry for electronic equipment or other hardware system).

Although the disclosure has been explained in relation to its preferred embodiment, it is to be understood that many other possible modifications and variations can be made without departing from the spirit and scope of the disclosure.

What is claimed is:

1. A method of electroplating comprising the successive steps of:

activating a surface of a substrate by a plurality of first counter flow conditioning rinses with a solution of acetone followed by a solution of alcohol;

rinsing the activated surface of the substrate;

drying the activated surface using a nitrogen gas;

cleaning the activated surface using a soak-clean solution comprising a concentration of 15% non-etch type alkaline cleaner;

activating the activated surface using an activator solution comprising a concentration of 20% activator;

rinsing the activated surface of the substrate using an ammonia dead rinse solution comprising a concentration of 5% ammonium hydroxide and deionized water;

conditioning the activated surface of substrate using a plurality of second counter flow conditioning rinses;

etching the activated surface of the substrate using a solution of a concentration of 20% hydrochloric acid;

rinsing the activated surface of the substrate using a plurality of third counter flow conditioning rinses;

depositing a nickel strike material and then electrolytic nickel metal on to the activated surface of the substrate;

electroplating a gold strike metal to the activated surface of the substrate; and electroplating a nano-silver material on to the activated surface of the substrate using an electrolytic solution and a rate of deposition 0.0001 μm/hr;

wherein the nano-silver material comprises a molecular formula of $[Ag_{25}(\text{thiolate})_{18}]^-$; and the electrolytic solution has a pH level of 3.5-6.5.

2. The method of claim 1, wherein the substrate comprises a connector comprising beryllium copper.

3. The method of claim 1, wherein the electroplating a nano-silver material further comprises a pulse plating method.

4. The method of claim 3, wherein the pulse plating method comprises:

a current density of 45-200 ASF;

a pulse frequency of 1-1200 Hz;

an on time of 0.3-3.0 ms;

an off time being 0.5-3.0 ms; and a duty cycle of 10-50%.

5. A method of electroplating a nanomaterial, comprising the successive steps of:

activating a surface of a substrate by a plurality of first counter flow conditioning rinses using a solution of acetone and a solution of an alcohol, rinsing the activated surface of the substrate;

drying the activated surface of the substrate using a nitrogen gas;

conditioning the activated surface of substrate using a desmear solution comprising a concentration of 15% conditioner;

rinsing the activated surface of the substrate using a deoxidation solution comprising a concentration of 30% deoxidant;

conditioning the activated surface of substrate using a plurality of second counter flow rinses;

rinsing the activated surface of the substrate using a second deoxidation solution comprising a concentration of 10% deoxidant;

rinsing the activated surface of the substrate using a plurality of third counter flow conditioning rinses;

depositing electrolytic copper and electrolytic nickel metal to the activated surface of the substrate;

electroplating a gold strike metal to the activated surface of the substrate of the substrate; and electroplating a nano-silver nanoparticle to the activated surface of the substrate wherein the substrate comprises a brass material or a leaded brass alloy;

the nano-silver nanoparticle comprises a molecular formula of $[Ag_{25}(thiolate)_{18}]^-$;

the electroplating utilizes an electroplating solution, the electroplating solution has a pH level of 3.5-6.5; and the electroplating comprises a rate of deposition of 0.0001 μm/hr.

6. The method of claim 5, wherein the electroplating a nano-silver nanoparticle uses a pulse plating method.

7. The method of claim 5, wherein the electroplating a nano-silver nanoparticle comprises a pulse electroplating method;

the pulse electroplating method comprises a plurality of cycles; and each cycle of the plurality of cycles is configured to deposit a material comprising a smaller grain size compared to a prior cycle of the plurality of cycles.

8. The method of claim 7, wherein the pulse electroplating comprises:

a current density of 45-200 ASF;

a pulse frequency of 1-1200 Hz;

the plurality of pulse cycles each comprising an on time of 0.3-3.0 ms and an off time of 0.5-3.0 ms; and a duty cycle being range from 10% to 50%.

9. The method of claim 7, wherein the pulse electroplating comprises a rate of deposition of 0.0001 μm/hr;

is performed at a temperature of 120-140° F.; and comprises a non-cyanide acidic silver electroplating bath solution having a pH of 3.5-6.5 and comprising:

a soluble silver salt;

a thiosulfate complex at 200-500 g/L;

trisodium citrate;

$[Ag_{25}(thiolate)_{18}]^-$ nanoparticles at 0.5-10 g/L;

one or more of silver nitride at 20-120 g/L;

trisodium citrate at 10-100 g/L;

sodium hydroxide at 5-75 g/L;

sodium nitride at 10-100 g/L;

sodium sulfate at 10-100 g/L;

a monosaccharide at 1-5 g/L;

benzoic acid at 1-10 g/L; and a sodium thiosulfate complex at 200-500 g/L.

10. The method of claim 9, wherein the substrate comprises a beryllium copper alloy.

* * * * *